US005826604A

United States Patent [19]

Hartmann

[11] Patent Number: 5,826,604

[45] Date of Patent: Oct. 27, 1998

[54] STANDING UMBRELLA

[76] Inventor: Hans-Jorg Hartmann, Dachsweg 1, D-85598 Baldham, Germany

[21] Appl. No.: 733,755

[22] Filed: Oct. 18, 1996

[30] Foreign Application Priority Data

Feb. 8, 1996 [DE] Germany ..... 196 04 599.1

[51] Int. Cl.[6] ..... A45B 25/02

[52] U.S. Cl. ..... 135/27; 135/28; 135/33.4

[58] Field of Search ..... 135/15.1, 19.5, 135/28, 27, 33.2, 33.4

[56] References Cited

U.S. PATENT DOCUMENTS

| | | | |
|---|---|---|---|
| 540,098 | 5/1895 | Grove et al. | 135/27 X |
| 1,666,692 | 4/1928 | Epstein | 135/15.1 X |
| 1,824,192 | 9/1931 | Bouma | 135/27 X |
| 2,114,598 | 4/1938 | Grissel | 135/15.1 |
| 2,143,978 | 1/1939 | Eeles | 135/27 X |
| 2,725,066 | 11/1955 | Estes et al. . | |
| 3,032,047 | 5/1962 | Wendorf | 135/27 X |
| 3,217,723 | 11/1965 | Suchy | 135/15.1 |
| 3,561,157 | 2/1971 | Lizasoain | 135/15.1 X |
| 4,934,394 | 6/1990 | Hermanson | 135/19.5 |
| 5,131,422 | 7/1992 | Aronov | 135/27 |
| 5,143,107 | 9/1992 | Kelley | 135/16 |

FOREIGN PATENT DOCUMENTS

| | | | |
|---|---|---|---|
| 572753 | 5/1988 | Australia . | |
| 760703 | 3/1934 | France . | |
| 2121123 | 8/1972 | France . | |
| 2193556 | 2/1974 | France . | |
| 529996 | 7/1931 | Germany . | |
| 1622508 | 6/1950 | Germany . | |
| 0846287 | 8/1952 | Germany | 135/15.1 |
| 1697929 | 5/1955 | Germany . | |
| 1828491 | 1/1961 | Germany . | |
| 37 08 921 | 9/1988 | Germany . | |
| 88 08 834 | 11/1989 | Germany . | |
| 90 01 602 | 6/1990 | Germany . | |
| 40 04 189 | 4/1991 | Germany . | |
| 44 17 890 | 1/1995 | Germany . | |
| 43 31 485 | 3/1995 | Germany . | |
| 501388 | 1/1971 | Switzerland . | |
| 540669 | 10/1973 | Switzerland . | |
| WO 87/04603 | 8/1987 | WIPO . | |

*Primary Examiner*—Lanna Mai
*Attorney, Agent, or Firm*—Collard & Roe, P.C.

[57] ABSTRACT

A standing umbrella includes an upright pole, a top affixed to the upper end of the upright pole, a slide member displaceably mounted on the upright pole, at least four tensioning struts having free outer ends and inner ends linked to the slide member at respective pivots, a flexible cover affixed to the tensioning struts, and flexible carrier elements extending between the top and the tensioning struts. Displacement of the slide member towards the lower end of the upright pole moves the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causes the umbrella to be closed. A flexible member extends between the tensioning struts and is affixed thereto for limiting the opening movement of the tensioning struts.

17 Claims, 3 Drawing Sheets

STANDING UMBRELLA

BACKGROUND OF THE INVENTION

1. Field of the Invention

The present invention relates to a standing umbrella, such as a large umbrella used, for example, in a garden, on the beach, in restaurants, in open markets or for display advertisements. Such standing umbrellas comprise an upright pole having an upper end and a lower end that may be anchored to a support, a top affixed to the upper end of the upright pole, a slide member displaceably mounted on the upright pole, at least four tensioning struts having free outer ends and inner ends linked to the slide member at respective pivots, a flexible cover affixed to the tensioning struts, and carrier elements extending between the top and the tensioning struts. Displacement of the slide member towards the lower end of the upright pole moving the tensioning struts into positions in which they almost extend perpendicularly to the upright pole opens the umbrella, and displacement of the slide member towards the upper end of the upright pole causes the umbrella to be closed.

2. Description of the Prior Art

German patent No. 3,708,921 discloses a large umbrella in which a fabric cover is guided over the top and is spread in an open position by means of tensioning struts linked to a slide member when the tensioning struts extend horizontally, i.e. enclose an angle of 180°. The tensioning struts are held in their horizontal position by carrier elements linked to the top and the tensioning struts while the radial tensioning of the cover is effectuated by telescoping springs provided at the ends of the tensioning struts. This subjects the tensioning struts to a flexing force. Also, opening and closing of the umbrella is relatively difficult and requires an actuating rod which pulls the slide member up and down against a stop.

SUMMARY OF THE INVENTION

It is the primary object of this invention to provide a standing umbrella of the above-described type, which is of simple and sturdy construction and which can be opened and closed without much effort.

The above and other objects are accomplished according to the invention with a standing umbrella comprising an upright pole having an upper end and a lower end that may be anchored to a support, a top affixed to the upper end of the upright pole, a slide member displaceably mounted on the upright pole, at least four tensioning struts having free outer ends and inner ends linked to the slide member at respective pivots, a flexible cover affixed to the tensioning struts, flexible carrier elements extending between the top and the tensioning struts, displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, and a flexible member extending between the tensioning struts and affixed thereto for limiting the opening movement of the tensioning struts.

Such a standing umbrella has the advantage of requiring relatively little effort for opening and closing it without the need for force-transmitting auxiliary means. The movements of the umbrella proceed ergonomically, and the opened umbrella may be obliquely positioned without a substantial displacement of its point of gravity. It is a further advantage that the pole and struts may be, as desired, tubular or solid, for example of wood, since the tensioning struts are subjected only to axial loads.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF THE PREFERRED EMBODIMENTS

Figure 1:
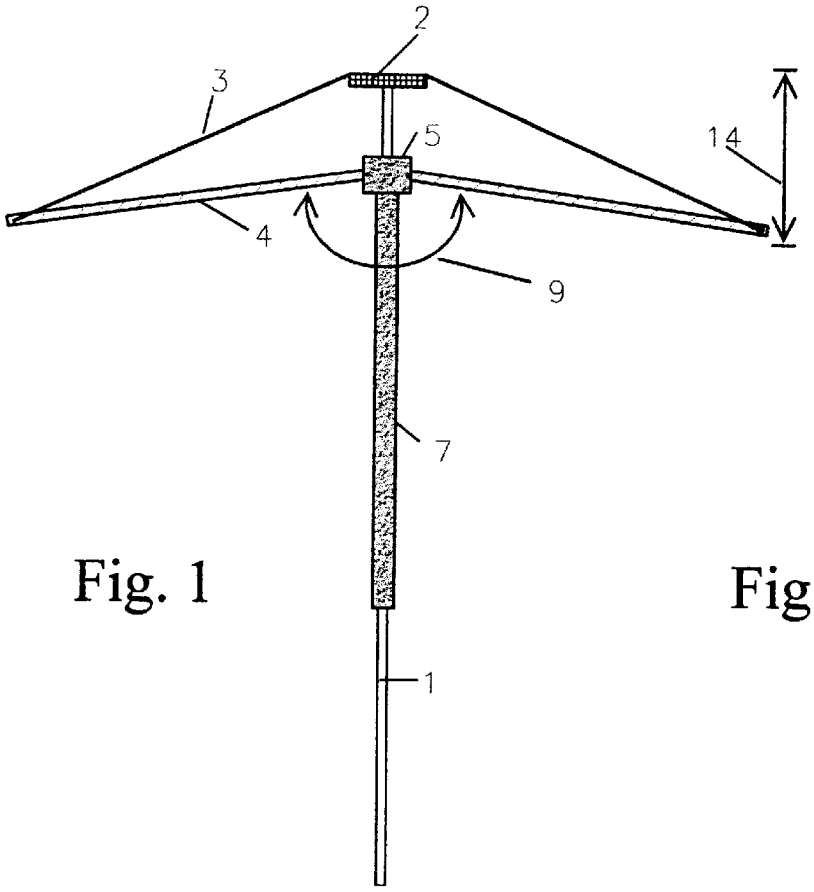
FIG. 1 is a side elevational view, partly in vertical section, of a standing umbrella according to this invention, in its opened position.

Referring now to the drawing, wherein like reference numerals in all figures designate like parts functioning in a like manner, there is shown a standing umbrella comprising upright pole 1 having an upper end and a lower end that may be anchored to a support (not shown). The upright pole may have a circular or polygonal, preferably rectangular, cross section and top plate 2 is affixed to the upper end of upright pole 1. Slide member 5 is displaceably mounted on the upright pole, and the inner ends of four tensioning struts 4 having free outer ends are linked to slide member 5 at respective pivots 17. A flexible cover 11, 12, 13 (see FIGS. 7*a,* 7*b,* 7*c*) is affixed to tensioning struts 4. Flexible carrier elements 3 extend between top 2 and tensioning struts 4. The illustrated flexible carrier elements are elongated members, such as ropes, affixed to the outer ends of the tensioning struts. Bands, chains, wires, nets, any type of textile fabric, sheets and the like may also be used as flexible elongated members forming the carrier elements. The cover itself could also constitute the flexible carrier elements.

Figure 2:
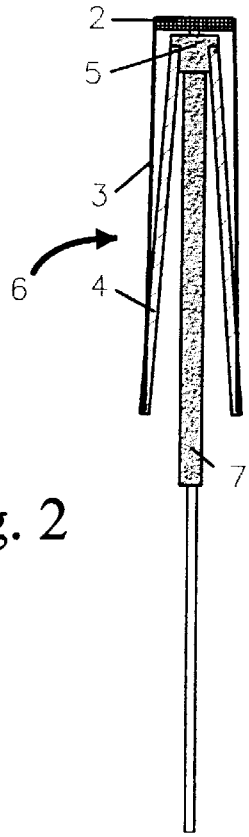
FIG. 2 shows the same view of the standing umbrella, in its closed position.

Displacement of slide member 5 towards the lower end of upright pole 1 moves tensioning struts 4 into positions in which they almost extend perpendicularly to the upright pole, diametrically opposite ones of the tensioning struts enclosing angle 9 of less than 180°, whereby the umbrella is opened (FIG. 1). As seen in FIG. 2, displacement of slide member 5 towards the upper end of the upright pole causes the umbrella to be closed. In other words, the tensioning struts are spread in the open position of the standing umbrella and are collapsed in its closed position. As shown, slide member 5 has tubular extension 7, which facilitates the operation of the umbrella and constitutes a weight. Flexible member 10 extends between tensioning struts 4 and is affixed thereto for limiting the opening movement of the tensioning struts so that angle 9 is held to less than 180°.

Tensioning struts 4 form a cone-shaped body, with slide member 5 at its center, and the maximum apex angle of this cone is limited by flexible member 10, which is illustrated as a circumferentially extending elongated element affixed to the outer ends of tensioning struts 4.

Figure 6:
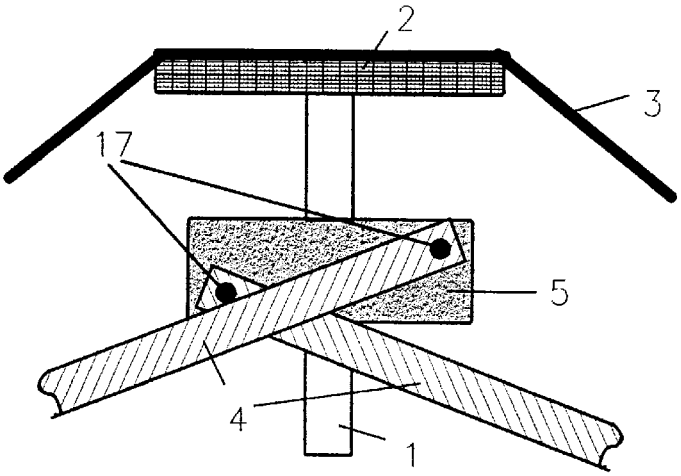
FIG. 6 is an enlarged fragmentary side view, showing a further embodiment featuring a special arrangement of the pivots linking the tensioning struts to the slide member.

Since opening of the umbrella causes some parts to move upwards while other parts move downwards, there is the possibility of balancing the gravity forces. However, over the entire displacement path of slide member 5, the force required to displace the slide member varies because of changing torque. At the beginning of the opening movement, this force may be relatively high. To reduce the initial force required to open the umbrella, the extension of top plate 2 may be increased to increase the initial torque. This result may also be achieved, as shown in FIG. 6, by positioning pivot 17 linking each tensioning strut 4 to slide member 5 at the side thereof opposite the side facing the outer end of the strut whereby the pivot and the outer end have a maximum distance from each other and the force required to open the umbrella is reduced. As shown, pivots 17 linking tensioning struts 4 to slide member 5 are so arranged that the tensioning struts intersect each other.

It may be advantageous to affix additional weights to slide member 5 or to the inner ends of tensioning struts 4 to reduce the actuating force of the umbrella. It is also possible to replace the circumferentially extending rope 10 by radial elongated elements, such as ropes, extending between the diametrically opposite tensioning struts. Furthermore, the limiting function of flexible member 10 could also be fulfilled by the cover of the umbrella.

Because of the large angle 9 enclosed by tensioning struts 4, the sheer weight of slide member 5 and of the tensioning struts causes a relatively large force to be required for spreading the cover of the umbrella.

Figure 4:
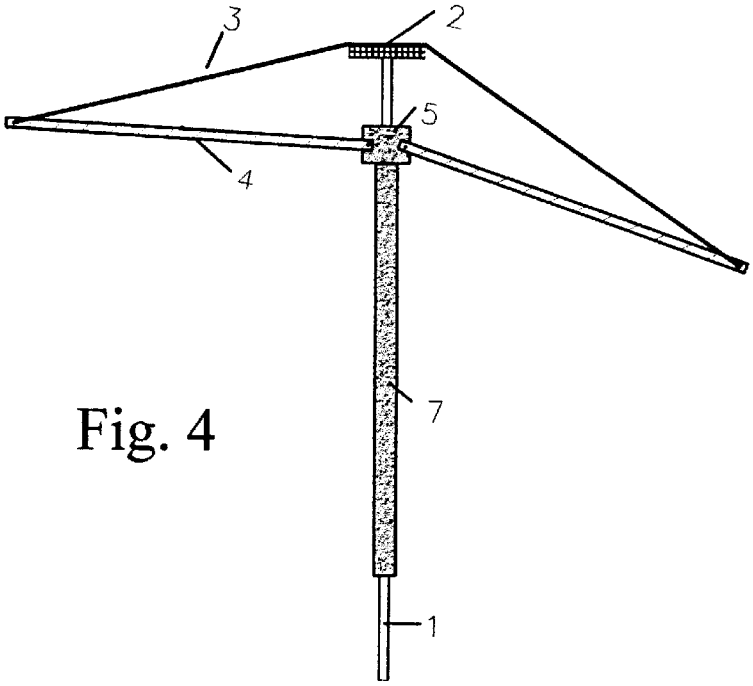
FIG. 4 is a side elevational view of the umbrella of FIG. 1, in a tilted position.
Figure 5:
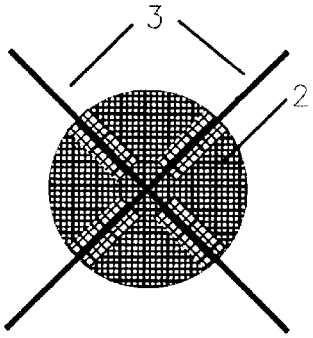
FIG. 5 is an enlarged fragmentary top view, showing the top and the position of the flexible carrier elements.

In a preferred embodiment shown in FIG. 5, diametrically opposite flexible carrier elements 3 are connected to form a unit consisting of a rope extending over top plate 2 and being held and guided by the top plate. As shown in FIG. 4, the unit forming the diametrically opposite flexible carrier elements is displaceable in a longitudinal direction thereof from a symmetrical position relative to the upright pole (FIG. 1) to an eccentric position while the length of the unit is retained. The opened umbrella may be held in this tilted position on top plate 2 by conventional clamping means (not shown) to fix the units in the selected position.

Figure 7A:
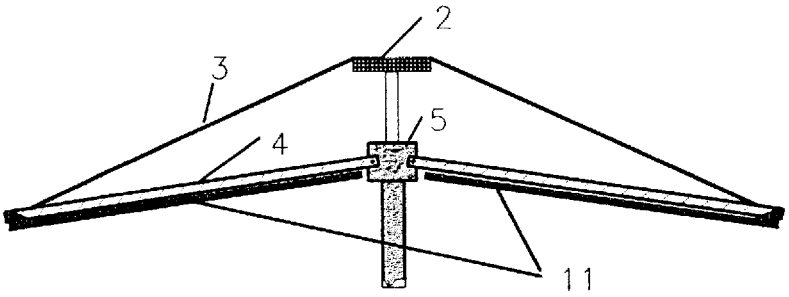
FIGS. 7*a,* 7*b* and 7*c* are fragmentary side views of the standing umbrella, showing three different arrangements of the cover.
Figure 7B:
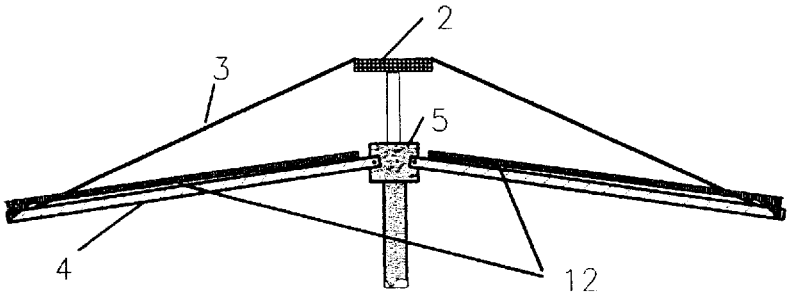
Figure 7C:
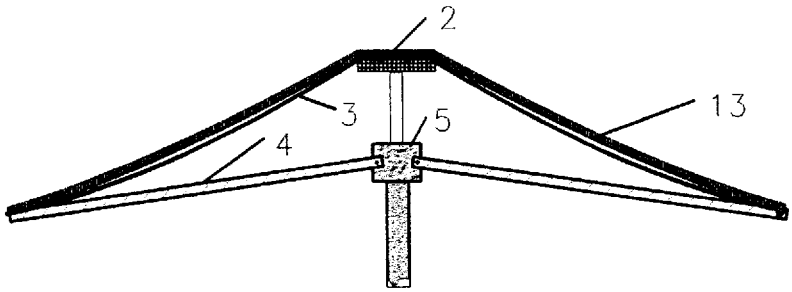

As shown in FIGS. 7*a,* 7*b* and 7*c,* the flexible umbrella cover defines a central aperture permitting upright pole 1 and slide member 5 to pass therethrough. In the embodiment of FIG. 7*a,* cover 11 extends below tensioning struts 4. In the embodiment of FIG. 7*b,* cover 12 rests on the tensioning struts. In the embodiment of FIG. 7*c,* cover 13 extends above the upper end of upright pole 1 and to the outer ends of tensioning struts 4, covering flexible carrier elements 3 and top plate 2. In all three embodiments, the flexible umbrella cover is affixed to tensioning struts 4 at least at the free outer ends thereof. In the tilted position of the umbrella (FIG. 4), the flexible cover is also tilted. Any slight deformations are equalized by the flexible carrier rope system.

Figure 3A:
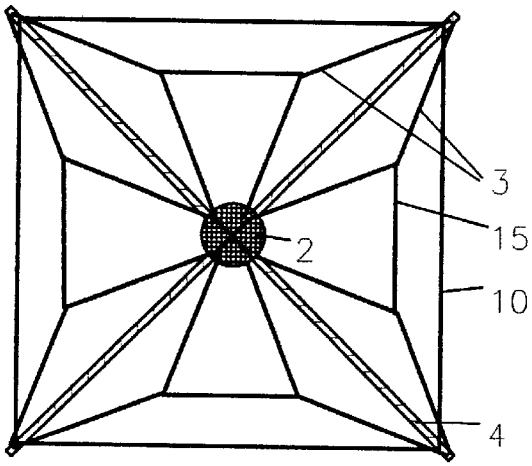
FIG. 3*a*is a top view of a standing umbrella of quadratic shape.
Figure 3B:
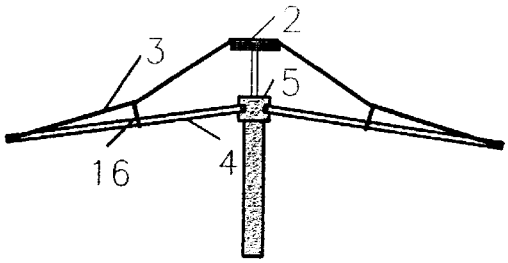
FIG. 3*b* fragmentary side elevational view of another embodiment of standing umbrella.

According to a preferred feature of the invention, height 14 (FIG. 1) of the conical umbrella roof constituted by spread flexible carrier elements 3 is held to a minimum. Without worsening the initial torque, this can be achieved by reducing the effective length of the flexible carrier elements at a selected angle 9 by radially or tangentially deforming the flexible carrier elements in dependence on this angle. As shown in FIGS. 3*a* and 3*b,* such deformations of flexible carrier elements 3 may be obtained by connecting elements 16 between flexible carrier elements 3 and tensioning struts 4 associated therewith (FIG. 3*b*). In the embodiment illustrated in FIG. 3*a,* the flexible carrier elements are two elongated members, i.e. ropes, affixed to the outer ends of each tensioning strut 4, and connecting elements 15, which may also be ropes, connect adjacent ones of the elongated members 3.

What is claimed is:

1. A standing umbrella comprising (a) an upright pole having an upper end and a lower end that may be anchored to a support, (b) a top extending in a horizontal plane and affixed to the upper end of the upright pole, (c) a slide member displaceable mounted on the upright pole, (d) at least four tensioning struts having free outer ends and inner ends linked to the slide member at respective pivots, (e) a flexible cover affixed to the tensioning struts, (f) flexible carrier elements associated with the tensioning struts and extending between contact points at the top and the tensioning struts, (1) displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, (2) the contact points of the flexible carrier elements at the top having a maximum distance from the pivots of the associated tensioning struts in a horizontal direction whereby the force required for the displacement is reduced, and (3) diametrically opposite ones of the flexible carrier elements being connected to form a unit extending over the top and being held and guided by the top, and (g) a flexible member extending between the tensioning struts and affixed thereto for limiting the opening movement of the tensioning struts.

2. The standing umbrella of claim 1, wherein the flexible carrier elements are elongated members affixed to the outer ends of the tensioning struts.

3. The standing umbrella of claim 2, wherein the slide member has a respective side at each side of the upright pole, and the pivot linking each tensioning strut to the slide member is positioned at the side thereof opposite the side facing the outer end of the strut whereby the pivot and the outer end have a maximum distance from each other and the force required to open the umbrella is reduced.

4. The standing umbrella of claim 2, wherein the elongated members are cords, bands, chains, wires, nets, textile fabrics or sheets separate from the flexible cover.

5. The standing umbrella of claim 1, wherein the flexible carrier elements are part of the flexible cover affixed to the outer ends of the tensioning struts.

6. The standing umbrella of claim 1, wherein a circumferentially extending elongated element affixed to the outer ends of the tensioning struts constitutes the flexible member extending between adjacent ones of the tensioning struts.

7. The standing umbrella of claim 1, wherein the flexible member is part of flexible cover affixed to the outer ends of the tensioning struts.

8. The standing umbrella of claim 1, wherein a radial elongated element extending between the diametrically opposite tensioning struts constitutes the flexible member.

9. The standing umbrella of claim 1, further comprising a weight means attached to the inner ends of the tensioning struts.

10. The standing umbrella of claim 8, wherein the weight means comprises a tubular extension of the slide member.

11. The standing umbrella of claim 1, wherein the unit forming the diametrically opposite flexible carrier elements is displaceable in a longitudinal direction thereof from a symmetrical position relative to the upright pole to an eccentric position while the length of the unit is retained, and further comprising clamping means for fixing the units in the selected position.

12. The standing umbrella of claim 1, wherein the pivots linking the tensioning struts to the slide member are so arranged that the tensioning struts intersect each other.

13. The standing umbrella of claim 1, wherein the flexible cover extends above the upper end of the upright pole and to the outer ends of the tensioning struts, covering the flexible carrier elements and the top.

14. A standing umbrella comprising (a) an upright pole having an upper end and a lower end that may be anchored to a support, (b) a top extending in a horizontal plane and affixed to the upper end of the upright pole, (c) a slide member displaceable mounted on the upright pole, (d) at least four tensioning struts having free outer ends and inner ends linked to the slide member at respective pivots, (e) a flexible cover affixed to the tensioning struts, (f) flexible carrier elements associated with the tensioning struts and extending between contact points at the top and the tensioning struts, (1) displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, and (2) the contact points of the flexible carrier elements at the top having a maximum distance from the pivots of the associated tensioning struts in a horizontal direction whereby the force required for the displacement is reduced, (g) a flexible member extending between the tensioning struts and affixed thereto for limiting the opening movement of the tensioning struts, and (h) connecting elements between the flexible carrier elements and the tensioning struts associated therewith.

15. A standing umbrella comprising (a) an upright pole having an upper end and a lower end that may be anchored to a support, (b) a top extending in a horizontal plane and affixed to the upper end of the upright pole, (c) a slide member displaceable mounted on the upright pole, (d) at least four tensioning struts having free outer ends and inner ends linked to the slide member at respective pivots, (e) a flexible cover affixed to the tensioning struts, (f) flexible carrier elements associated with the tensioning struts and extending between contact points at the top and the tensioning struts, the flexible carrier elements being two elongated members affixed to the outer ends of each tensioning strut, (1) displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, and (2) the contact points of the flexible carrier elements at the top having a maximum distance from the pivots of the associated tensioning struts in a horizontal direction whereby the force required for the displacement is reduced, (g) a flexible member extending between the tensioning struts and affixed thereto for limiting the opening movement of the tensioning struts, and (h) connecting elements between adjacent ones of the elongated members.

16. A standing umbrella comprising (a) an upright pole having an upper end and a lower end that may be anchored to a support, (b) a top extending in a horizontal plane and affixed to the upper end of the upright pole, (c) a slide member displaceable mounted on the upright pole, (d) at least four tensioning struts having free outer ends and inner ends linked to the slide member at respective pivots, (e) a flexible cover affixed to the tensioning struts, (1) the flexible cover extending above the tensioning struts and defining a central aperture permitting the upright pole and slide member to pass therethrough, (f) flexible carrier elements associated with the tensioning struts and extending between contact points at the top and the tensioning struts, (1) displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, and (2) the contact points of the flexible carrier elements at the top having a maximum distance from the pivots of the associated tensioning struts in a horizontal direction whereby the force required for the displacement is reduced, and (g) a flexible member extending between the tensioning struts and affixed thereto for limiting the opening movement of the tensioning struts.

17. A standing umbrella comprising (a) an upright pole having an upper end and a lower end that may be anchored to a support, (b) a top extending in a horizontal plane and affixed to the upper end of the upright pole, (c) a slide member displaceable mounted on the upright pole, (d) at least four tensioning struts having free outer ends and inner ends linked to the slide member at respective pivots, (e) a flexible cover affixed to the tensioning struts, (1) the flexible cover extending below the tensioning struts and defining a central aperture permitting the upright pole and slide member to pass therethrough, (f) flexible carrier elements associated with the tensioning struts and extending between contact points at the top and the tensioning struts, (1) displacement of the slide member towards the lower end of the upright pole moving the tensioning struts into positions in which they almost extend perpendicularly to the upright pole, diametrically opposite ones of the tensioning struts enclosing an angle of less than 180°, whereby the umbrella is opened, and displacement of the slide member towards the upper end of the upright pole causing the umbrella to be closed, and (2) the contact points of the flexible carrier elements at the top having a maximum distance from the pivots of the associated tensioning struts in a horizontal direction whereby the force required for the displacement is reduced, and (g) a flexible member extending between the tensioning struts and affixed thereto for limiting the opening movement of the tensioning struts.

* * * * *